US006440528B1

(12) United States Patent
Pike

(10) Patent No.: US 6,440,528 B1
(45) Date of Patent: Aug. 27, 2002

(54) WIND AND SUN TOLERANT MESH

(75) Inventor: Walter Pike, 14 Argyll Street, Coffs Harbour NSW 2450 (AU)

(73) Assignee: Walter Pike, Coffs Harbour (AU)

( * ) Notice: Subject to any disclaimer, the term of this patent is extended or adjusted under 35 U.S.C. 154(b) by 0 days.

(21) Appl. No.: 09/197,552

(22) Filed: Nov. 23, 1998

(51) Int. Cl.[7] ..... B32B 7/00; D04H 1/00; D04H 9/00

(52) U.S. Cl. ..... 428/119; 428/12; 428/52; 428/179; 442/2; 442/20; 442/50; 442/185; 442/186; 160/166.1

(58) Field of Search ..... 428/119, 179, 428/12, 52; 442/2, 20, 50, 185, 186; 160/166.1

(56) References Cited

U.S. PATENT DOCUMENTS 4,379,798 A * 4/1983 Palmer et al. ..... 428/113

4,679,519 A * 7/1987 Linville ..... 114/103

* cited by examiner

*Primary Examiner*—Terrel Morris
*Assistant Examiner*—Ula C. Ruddock
(74) *Attorney, Agent, or Firm*—Walter Pike

(57) ABSTRACT

A Wind and Sun Tolerant Mesh is disclosed which is composed of either natural or synthetic material, the generally vertical directional strands crossed by horizontal strands, some or all of which individual horizontal strands of which broaden out on one side forming as sill which projects outward at an angle away from the plane surface of the mesh in a venetian blind profile, and wind baffling effect, while simultaneously allowing release of any excess pressure from wind gusting into the opposite side due to the semi permeable nature of the mesh and as there is no restricting sill on the inside surface, thus giving better control and protection to either articles or utilities made from, and/or persons or property protected by, commodities of any various sort constructed wholly or partly from the mesh.

1 Claim, 1 Drawing Sheet

WIND AND SUN TOLERANT MESH

CROSS REFERENCE TO RELATED APPLICATION

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

This invention is directed to an improved mesh which gives protection from strong wind and sun to persons or property. These conditions affect all sorts of situations. Any previous types of mesh or materials are limited in this multiple role of enhanced sun and/or wind protection combined with strong wind tolerance,

BRIEF SUMMARY OF THE INVENTION

These aspects are overcome in the present invention, which is a mesh, constructed either wholly or partly of either natural or synthetic made material, the segments of which are constructed by generally vertical directional strands crossed by horizontal strands either knitted, woven or fused, to the vertical strands, the mesh being of optionally variable number of segments per unit area, and the individual horizontal strands broadening only on one side to form a sill which projects at an angle away from the plane surface of the mesh in a venetian blind profile, such sill as shown in accompanying drawing, thereby enhancing deflection of sun's rays and has a stronger wind baffling effect while allowing some permeation of wind pressure through the mesh, thus relieving full wind pressure and damage on the mesh itself, and still obtaining greater sun and wind protection to persons or property protected thereby. Reducing of excess sudden wind gusting from the lee side is also released from that side through the mesh, as there is no restricting sill on that side, thus also protecting the mesh from damage or dislodgement.

The material constructed in this way can be utilized in any place, situation or commodity where applicable, thus giving better control or protection to either articles made from or protected by the mesh.

DETAILED DESCRIPTION OF THE INVENTION

Figure 1:
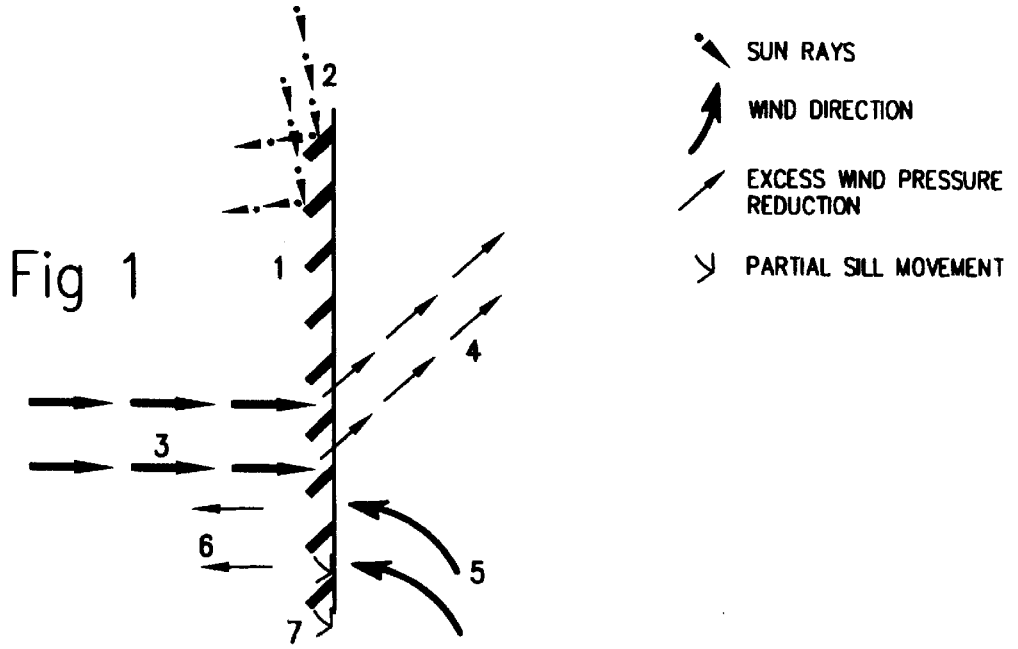
FIG. 1. Shows diagram of end view of mesh, greatly enlarged, demonstrating end view of individual external mesh sills I on left hand side, resultant in increased diverting of sun's rays 2, enhanced external main wind baffling 3, allowing only partial penetration and enhanced reduction of wind pressure on leeward, right hand side 4, also tendency of sill to partially close under pressure is indicated 7, especially so when more resilient material is used in mesh construction. Release of excess sudden wind gusting from lee side is also shown in 5,6.
Figure 2:
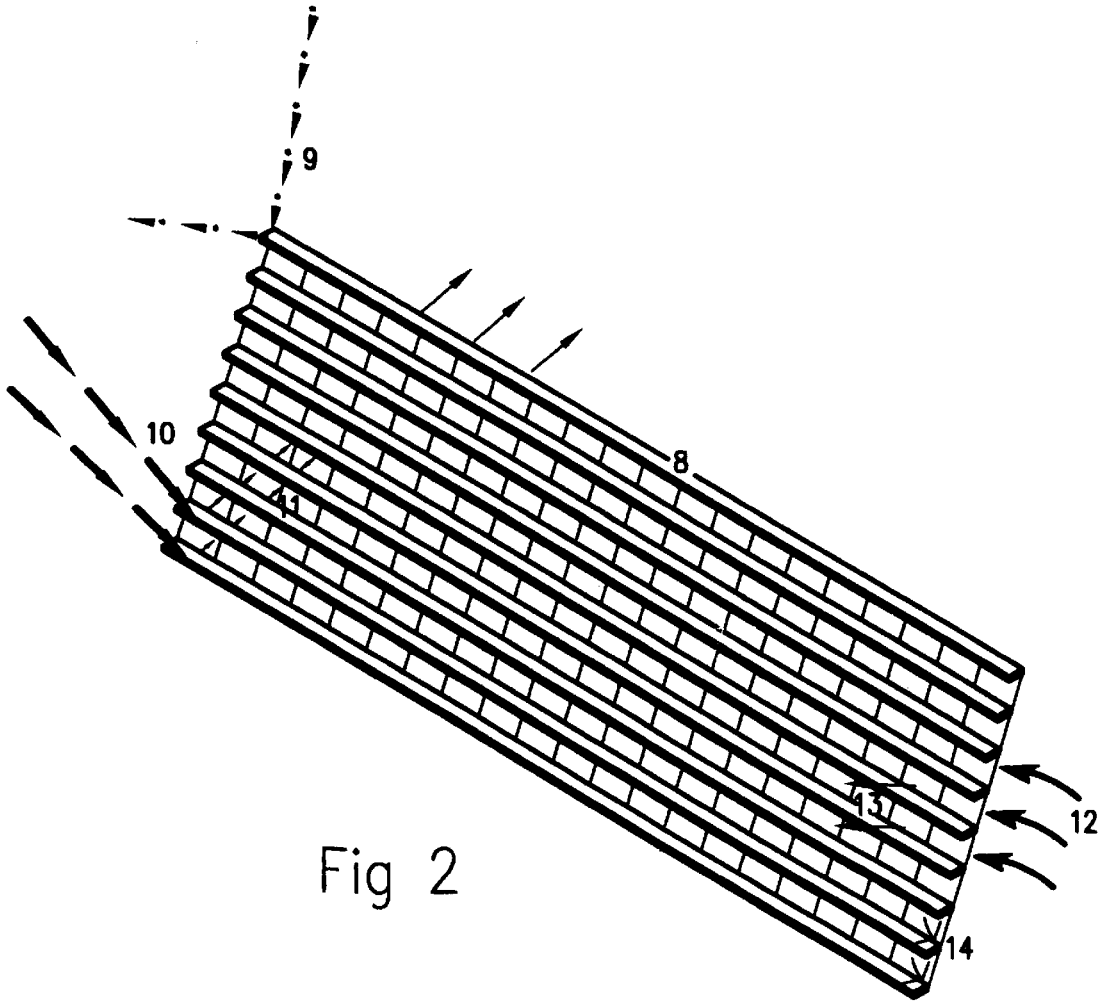
FIG 2. Shows diagram of frontal view, greatly enlarged, of section of mesh showing individual horizontal sill lines 8 resultant in increased, diverting of sun's rays 9 enhanced external main wind baffling 10 allowing only partial penetration 11 and enhanced reduction of wind pressure on leeward side. The sill tendency to partially close under pressure is indicated 14 especially so when more resilient material is used in mesh construction.

Reference to FIG. 1 and FIG. 2 shows a diagrammatic view of a mesh constructed either wholly or partly of either natural or synthetic made material, the segments of which are constructed by generally vertical directional strands crossed by horizontal strands either knitted, woven or fused to the vertical strands, the mesh being of optionally variable number of segments per unit area, and the individual horizontal strands broadening only on one side to form a sill END view FIG. 1, 1 and FIG. 2, 8 which projects at an angle away from the plane surface of the mesh in a venetian blind profile, such sill as shown in accompanying drawing, thereby enhancing deflection of sun's rays FIG. 1, 2 and FIG. 2 9 and has a stronger wind baffling effect FIG. 1, 3 and FIG. 2 while allowing some permeation of wind pressure through the mesh, FIG. 1 4 and FIG. 2 11 thus relieving full wind pressure and damage on the mesh itself, and still obtaining greater sun and wind protection to persons or property protected thereby. Reducing of excess sudden wind gusting from the lee side FIG. 1 5 and FIG. 2 12 is also released from that side through the mesh FIG. 1 6 and FIG. 2 13 and there is no restricting sill on that side, thus also protecting the mesh from damage or dislodgement. The material constructed in this way can be utilized in any place, situation or commodity where applicable, thus giving better control or protection to either articles made from or protected by the mesh. In other forms of the invention the angle of the sill can be constructed to any desired angle for varied. sun or wind optional requirements.

In another form of the invention the construction material can be more resilient allowing the sill when under stronger wind pressure to close off further to the plane surface of the material, thereby decreasing wind permeability and increasing wind protection on the lee ward side, FIG. 1 7 and FIG. 2 14. In any of the various forms of the invention it can be adapted for use as secondary cover or as components of such things as tents, awnings, annexes, protective screens, hats, or any other commodity whatsoever.

In another form of the invention it can be adapted as an umbrella canopy or portion thereof, optionally provided with a waterproof elasticized detachable skin which fits across canopy and fastens with loops to projecting frame-rib ends at canopy perimeter.

The invention is defined in the following claims:

1. A mesh, which is constructed either wholly or partly of either natural or synthetic made material, the segments of which are constructed by generally vertical directional strands crossed by horizontal strands either knitted, woven or fused to the vertical strands, the mesh being of optionally variable number of segments per unit area, and some or all of the individual horizontal strands broadening only on one side to form a sill which projects at an angle away from the plane surface of the mesh, in a venetian blind profile.

* * * * *

UNITED STATES PATENT AND TRADEMARK OFFICE

CERTIFICATE OF CORRECTION

PATENT NO. : 6,440,528 B1
DATED : August 27, 2002
INVENTOR(S) : Pike

It is certified that error appears in the above-identified patent and that said Letters Patent is hereby corrected as shown below:

Column 2,
Lines 54 through 62, replace with the following:
-- 1. An open mesh comprising vertical and horizontal elements wherein the horizontal elements have longitudinal edges, a width greater then their thickness, and are attached to the vertical elements along one edge such that the opposite edge extends away from the vertical elements, so as to form a Venetian blind profile. --

Signed and Sealed this

Eleventh Day of February, 2003

JAMES E. ROGAN
*Director of the United States Patent and Trademark Office*